United States Patent [19]

Large et al.

[11] Patent Number: 4,898,303

[45] Date of Patent: Feb. 6, 1990

[54] CUP-TYPE DRINK MERCHANDISER WITH BAG-IN-BOX PRODUCT SUPPLY SYSTEM

[75] Inventors: Danny E. Large, Newark; Mark S. Tschanen, Columbus, both of Ohio

[73] Assignee: Liqui-Box Corporation, Worthington, Ohio

[21] Appl. No.: 263,583

[22] Filed: Oct. 27, 1988

[51] Int. Cl.[4] ..... B67D 1/16

[52] U.S. Cl. ..... 222/65; 137/312; 141/86; 141/95; 141/114; 222/66; 222/67; 222/108; 222/136; 222/145

[58] Field of Search ..... 222/57, 64, 65, 66, 222/67, 105, 108, 129.1, 129.2, 129.3, 129.4, 130, 131, 136, 145, 183; 141/86, 88, 198, 114, 95, 94; 137/312, 313; 221/96

[56] References Cited

U.S. PATENT DOCUMENTS

| | | | |
|---|---|---|---|
| 2,520,380 | 8/1950 | Wegman | 222/108 |
| 2,614,738 | 10/1952 | Mills | 222/129.3 X |
| 2,838,077 | 6/1958 | Cooper | 141/88 X |
| 3,015,419 | 1/1962 | Arnett et al. | 222/130 |
| 3,021,035 | 2/1962 | Hill | 222/108 X |
| 3,200,992 | 8/1965 | Maxwell | 222/67 X |
| 3,380,628 | 4/1968 | Cox, Jr. | 222/105 X |
| 3,667,499 | 6/1972 | Branton et al. | 222/145 X |
| 3,702,666 | 11/1972 | Stano | 221/96 X |
| 3,794,219 | 2/1974 | Pitel et al. | 222/108 |
| 3,845,787 | 11/1974 | Slagle | 222/130 X |
| 3,976,225 | 8/1976 | Koeneker | 222/108 |
| 4,275,823 | 6/1981 | Credle, Jr. | 222/136 X |
| 4,286,636 | 9/1981 | Credle | 222/501 X |
| 4,421,146 | 12/1983 | Bond et al. | 251/149.1 |
| 4,445,551 | 5/1984 | Bond et al. | 251/149.1 |
| 4,467,941 | 8/1984 | Du | 222/66 X |
| 4,493,435 | 1/1985 | Hartley | 222/136 X |
| 4,641,680 | 2/1987 | Been | 222/108 X |
| 4,819,677 | 4/1989 | Stern | 134/104.2 |

OTHER PUBLICATIONS

Bulletins: National Vendors showing the Cold Drink Merchandiser Dual Simplicity CDM-314 and also showing the Imperial Crown CDM-314, Liqui-Box showing the Q C/D Beverage Syrup System.

*Primary Examiner*—Kevin R. Shaver

*Attorney, Agent, or Firm*—William V. Miller; Sidney W. Millard

[57] ABSTRACT

A cup type liquid dispensing machine in which the liquid-supplying system is a closed airtight circuit in the form of bag-in-box packages. The packages are connected to a dispensing pump which supplies the liquid to a dispensed and supported cup. Waste liquids from the machine are collected by various lines which are coupled to a flexible bag. A movable member engages the bag and activates a control switch to stop the machine as the bag becomes full.

7 Claims, 2 Drawing Sheets

CUP-TYPE DRINK MERCHANDISER WITH BAG-IN-BOX PRODUCT SUPPLY SYSTEM

FIELD OF THE INVENTION

This invention relates to that type of drink vending machine, usually coin operated, in which the drink or other liquid which may or may not be carbonated is dispensed in a cup supplied by the machine with or without ice.

PRIOR ART

Machines of this type usually take the form of a large cabinet with all the operating mechanism enclosed within the cabinet. This mechanism usually includes a product supply system, a cup dispenser, a refrigerating system or icemaker, and may include a liquid carbonating system. The liquid supplying system is usually designed to supply several different liquids, for example, several types of beverages as syrups. These several syrups are usually contained in large upstanding syrup tanks and dispensed by means of syrup pumps which are connected to the respective dispensing nozzles located above the respective drainage type cup platforms or supports. The syrup tanks are usually open at their upper ends but have loose caps or lids which normally rest lossely in place at these ends. At intervals of use of the machine the tanks are filled with a new supply of syrup by removing the lids and pouring the syrup into the tanks. Obviously, this arrangement is not sanitary since the lids may be displaced possibly allowing vermin and insects to enter the tanks and spillage may occur during the pouring of the liquid into the tank making unsanitary conditions in the cabinet. Also it is important to clean the tanks from time-to-time and there is a tendency to neglect this unpleasant task. Furthermore, with these prior art machines the waste-liquid collecting means usually consists of an open container or bucket in the bottom of the cabinet which receives the cup-overflow liquid from the drainage cup platforms or supports and other waste liquid from the icemaker, the water bath and carbonating system if used. This open waste container will attract insects and vermin and spillage often occurs during the emptying of it.

SUMMARY OF THE INVENTION

This invention relates to means for improving the sanitary conditions of a cup-type liquid-dispensing machine of the nature described above and which includes means for dispensing the liquid product from a supply system to cups disposed successful on suitable platform support. According to this invention the supply and dispensing system is a completely closed airtight system so it will be sanitary and takes the form of a disposable bag-in-box package for each product or syrup which is connected by a quick-connect/disconnect coupling to a line leading to a pump which pumps the syrup to the nozzle over the cup on its platform which is selected by the user. Thus, the system is completely closed and sanitary and is not subject to spillage and when the bag is emptied, the bag and box package can be discarded and be replaced with a full package. Thus, there is no need for cleaning any liquid-supply containers. The invention also includes means for receiving waste liquid into a bag which can be discarded. This is accomplished by connecting various tubes that receive waste liquids developed in the machine in a closed system by a quick-connect/disconnect coupling to a flexible bag which is removed when filled and is then replaced.

According to this invention the supply system for each product dispensed from the machine includes a pair of disposable bag-in-box packages. These packages are connected to the pump through a change-over vacuum valve which automatically cuts off the connection to the second bag when it is empty. Thus, at that time the second package can be removed from that line and be replaced with a full package.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
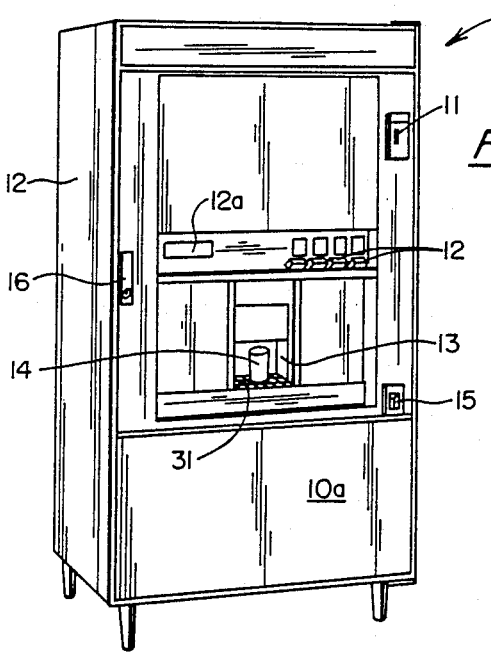
FIG. 1 is a perspective view of a type of vending machine now commonly in use to which this invention may be applied.
Figure 2:
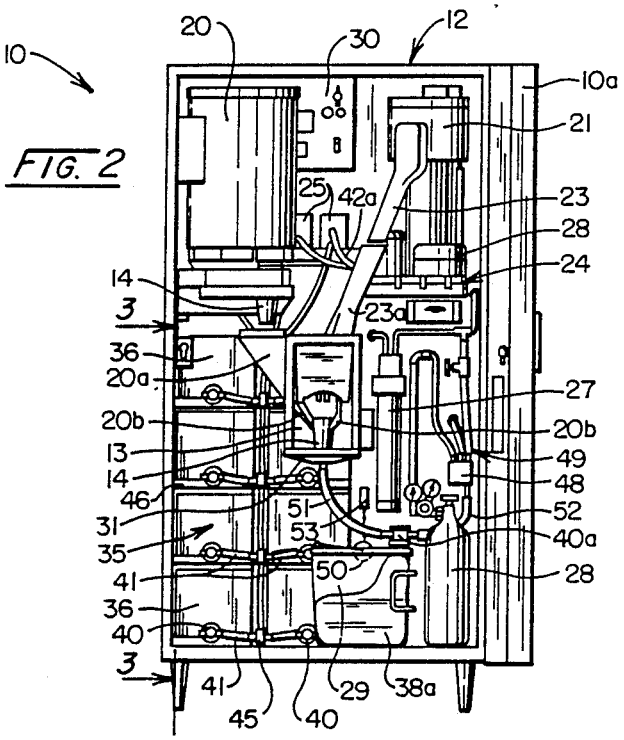
FIG. 2 shows the machine with the front panel swung to open position.
Figure 3:
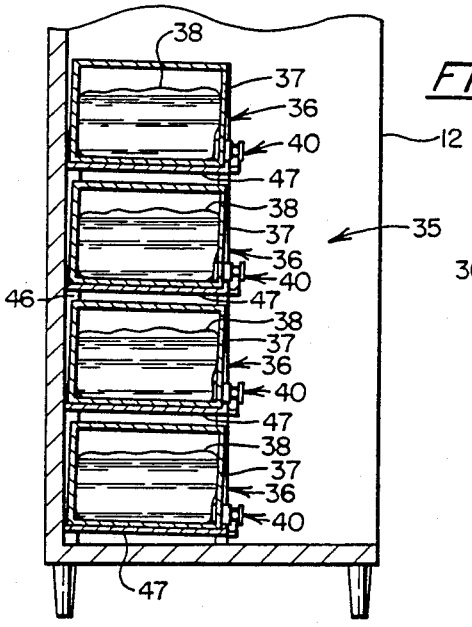
FIG. 3 is an enlarged partial vertical section of the machine taken on line 3–3 of FIG. 2 showing the stacked bag-in-box packages.
Figure 3A:
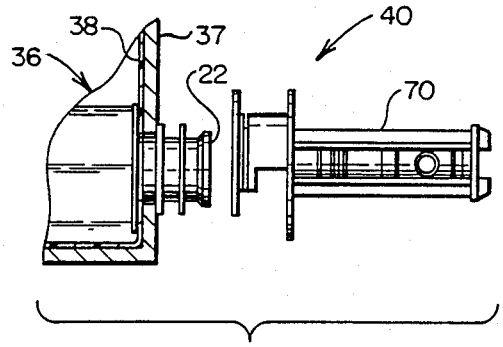
FIG. 3A is an enlarged partial sectional view of the quick-connect/disconnect coupling and bag-in-box.
Figure 4:
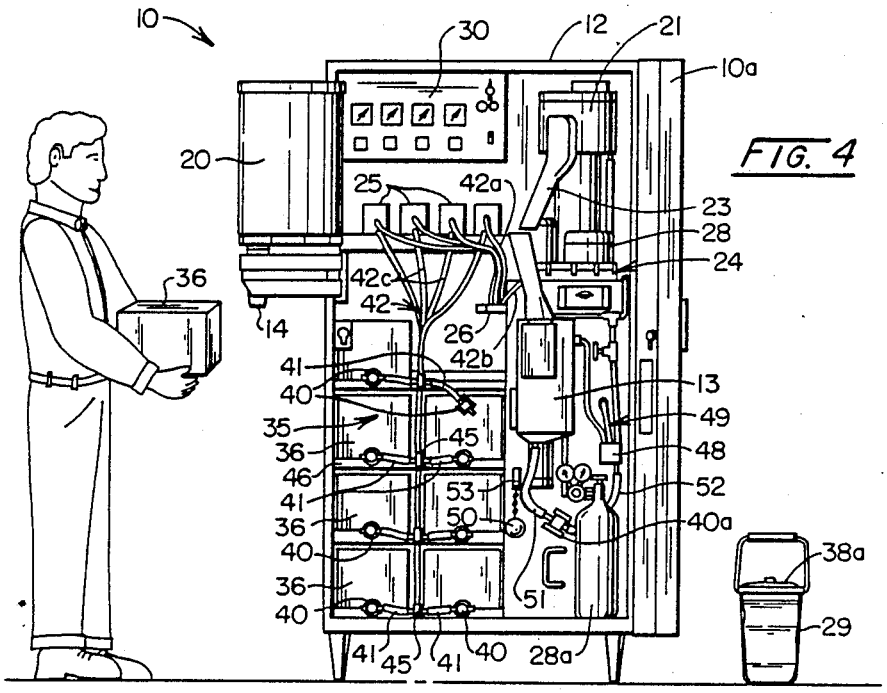
FIG. 4 is a view similar to FIG. 2 with units swung outwardly for clarity.

With specific reference to the drawings, FIGS. 1, 2 and 4 illustrate generally a machine 10 of a type now commonly in use for vending a plurality of carbonated beverages with or without ice. This is an example of a machine to which this invention can be applied. On the hinged front panel 10*a* of the machine is illustrated the coin slot 11, the beverage selecting buttons 12 and no ice button 12*a*, the dispensing cup receiving and dispensing chamber 13 with a cup 14 in position to receive the beverage syrup and water with or without ice, the coin return outlet 15, and the handle and lock 16 for the front panel 10*a*.

The front hinged panel 10*a* is shown in an open position to which it is swung for access to the interior of the cabinet 12 in FIG. 2 and in FIG. 4 some of the units are swung outwardly for access to certain units. The equipment within the cabinet includes a cup dispensor 20 pivoted for horizontal swinging which dispenses the cups 14 into a chute 20*a*, an ice dispenser 21 which may dispense ice, in accordance with the customr's choice, and which directs the ice into a chute 23, a water supply unit 24, a series of pumps 25 corresponding in number to the beverages to be selected, a syrup dispenser head 26 above the chamber 13, a water supply filter 27, a $CO_2$ tank 28*a* which supplies carbonator 28 and a waste liquid disposal container 29 at the bottom of the cabinet. At the top of the cabinet is the control panel 30. These and other units are usually provided in a machine of this type. However, this invention is not limited to the use of all of these units. It will be noted that the ice chute 23 directs the ice into a lower chute extension 23*a* which leads into the dispenser chamber 13 and directs the ice into the cup 14 which is supported on a platform 31 at the bottom of chamber 13 which is perforated and has a collecting chamber below it for collecting overflow from the cup. Also, the cup chute 20*a* directs the dispensed cups into position below the dispensing head 26 by means of guides 2*b*. The pumps 25 have their discharge lines 42a connected to the nozzles of the dispensing head 26 for the various beverages. The dispensing head 26 is also connected by a line 42b to the water supply unit 24 and the carbonator 28. According to this invention all of the pumps are connected by a closed airtight sanitary circuit 42 to a syrup supply system of the bag-in-box type indicated generally at 35.

The syrup supply system comprises bag-in-box packages each of which is indicated generally by the numeral 36. These packages are common in the art and consist of an outer box 37 enclosing a flexible bag 38 which has a spout through which it is filled and emptied. According to this invention each spout is coupled to a discharge or dispensing line by a quick-connect-/disconnect coupling 40. This coupling is of the type illustrated in U.S. Pat. Nos. 4,421,146 and 4,445,551. As described in detail in those patents each coupling consists of a quick-connect valve assembly 22 in Pat. No. 4,445,551 carried by the spout of the bag as the package 36 is supplied and a quick-connect/disconnect service line connector and valve assembly 70 in Pat. No. 4,421,146 adapted to be connected normally to the valve assembly but readily disconnectable therefrom. A plurality of the packages 36 for each syrup to be dispensed are used as the supply. These packages are connected by service lines 41 to the inlet or suction lines 42c of the pumps 25. The line 41 between the two packages shown is provided with a change-over shut-off valve 45, preferably of the vacuum operated type. A suitable valve commonly used in the art is a transfer valve manufactured by FLOJET CORPORATION, of Irvine, Calif., U.S.A. This valve will close to the second bag and open to the first bag when the second bag of the series is emptied and reaches a vacuum of at least eighteen inches mercury. At this time the coupling 40 to the second bag may be disconnected by removing the service line connector 70 from the valve assembly 22 on the emptied bag and the package can be replaced with a full package. When the second package is emptied the pump will withdraw syrup from the first package. Thus, the first package can supply liquid until it is emptied causing the valve 45 to switch back to the full second package.

The packages 36 are supported by a rack 46 at the rear of the cabinet. This rack is provided with pockets 47 for receiving the boxes of the packages and supporting them in forwardly inclined position with the spouts and couplings at the lower end of the box. An angle of eight-degrees has been found suitable to ensure drainage of the bag. The rack shown arranges the packages in a horizontal series for each flavor of syrup to be dispensed; two packages 36 being shown but could vary in number. Four rows are shown for containing syrup for four beverages. However, the number in each row and the number of rows can vary and can be horizontal as shown or vertical or a combination thereof.

In the operation of the syrup supply system the user selects the beverage to be dispensed and a cup 14 is deposited on a platform 31. The selected syrup is supplied by the pump 25 which withdraws it from the packages 36 of the one row. The syrup will be withdrawn independently from the second package but not from the first. However, as soon as the bag of the second package is emptied, the valve 45 closes to that bag and open to the first. Then the service line coupling can be disconnected from the valve assembly in the spout of the empty package and the package may be replaced with a full package by coupling the service line connector to the valve assembly on the new package.

As previously indicated this invention provides for a closed airtight sanitary disposed system. This includes a disposable flexible bag 38a disposed in the container 29 resting on the bottom of the cabinet as previously mentioned. Connected to the bag is a coupling 40a like the couplings 40 which as before includes a valve assembly on the spout and a service line connector connected to various inlets on the service line connector. These inlets receive the drain hose or line 51 coming from the waste drainage cup support platform 31, and drain line 52 coming from a manifold 48. This manifold receives various waste lines 49 which conduct waste water from the icemaker and dispenser, the water reservoir overflow and other parts of the machine. Thus, the waste is collected through the coupling 40a into the bag 38a disposed in container 29 which may be a bucket that can be lifted from the cabinet. The bag when in the container is engaged by a flat 50 which is suspended from a main control switch 53 which will deactivate the machine when the float is lifted to a certain level by filling of the bag. At this time the filled bag may be removed by disconnecting coupling 40a and be replaced with an empty bag. Thus, the waste liquids from the machine are also removed through a closed airtight circuit.

It will be apparent from the above description that this invention provides in a dispensing machine a completely closed airtight sanitary system for supplying liquid to a cup supported in a receiving position. This supply system preferably includes for each liquid dispensed a plurality, at least a pair, of bag-inb-x packages. These in-line-packages are connected to the inlet line of a pump and its outlet line is connected to a dispensing nozzle. The first bag is connected to the bag of a second package by a line that includes an automatic change-over cut-off valve, preferably of the vacuum type, which will close to the second bag and open to the first bag when the second bag is empty and the pump will then draw from the first bag. Thus the second package with its empty bag can be disconnected and be discarded and a new package with a full bag can be substituted for the removed bag. The system is completely closed not only for sanitary reasons but to exclude air to aid in preservation of the liquid. Consequently, the system could be used in dispensing liquids which should not be exposed to air, such as fruit juices.

Having thus described the invention what is claimed is:

1. A liquid dispensing machine for dispensing successively a plurality of liquids having a cup support for receiving and supporting successively liquid-receiving cups and having dispensing nozzles over the cup support for receiving the plurality of liquids, means for feeding cups successively onto said support, means for supplying a selected liquid to a selected nozzle, said supply means being in the form of a closed airtight supply system comprising first and second bag-in-box packages for each of said liquids connected to a service line of a supply pump, and a switch over cut-off valve in the service line between the bags of the first and second packages which will automatically switch when the one bag is emptied and said pump draws a vacuum of eighteen inches of mercury on the empty bag to thereby permit removal and replacement of that empty bag while the pump still draws liquid from the other bag, said box of each bag-in-box package including a generally flat lower surface, said flat surface being inclined downwardly toward said service line connection at an angle of about 8° to provide a gravity assist in emptying said package, said machine having one or more drainage tubes for draining waste liquid from the machine, and means for collecting that waste liquid, said collecting means comprising a disposable flexible bag connected by a coupling to said tubes, said bag being disposed in a relatively rigid container, and a switch for stopping the machine when the bag is full which is operated by contact with the bag, said bag being disconnectable from said tubes and removable from said container for disposal as a closed bag.

2. The combination of claim 1 in which the switch is operated by a float-ball engaging the bag.

3. The combination of claim 1 in which each of the bags has a spout which is coupled to a line leading to the pump.

4. The combination of claim 3 in which the spout is coupled to the line by a quick-connect/disconnect coupling, said coupling comprising a normally-closed valve in the spout and a service line connector which can be mounted on the spout to open the valve thereof.

5. The combination of claim 4 in which the service line connector has a valve which opens when mounted on the spout to permit flow into the service line connector from the spout but which closes when removed from the spout.

6. The combination of claim 5 in which the service line connector has means for closing the spout valve when removed from the spout.

7. The combination of claim 6 in which the service line connector includes a valve leading to the service line which closes when disconnected from the spout but opens when it is again connected to the spout.

* * * * *